US006583559B1

(12) United States Patent
Carretti et al.

(10) Patent No.: US 6,583,559 B1
(45) Date of Patent: Jun. 24, 2003

(54) GETTER DEVICE EMPLOYING CALCIUM EVAPORATION

(75) Inventors: Corrado Carretti, Milan (IT); Luca Toia, Carnago (IT); Claudio Boffito, Rho (IT)

(73) Assignee: SAES Getter S.p.A., Viale (IT)

( * ) Notice: Subject to any disclaimer, the term of this patent is extended or adjusted under 35 U.S.C. 154(b) by 198 days.

(21) Appl. No.: 09/603,418

(22) Filed: Jun. 22, 2000

(30) Foreign Application Priority Data

Jun. 24, 1999 (IT) ..... M199A1409

(51) Int. Cl.[7] ..... H01J 61/26

(52) U.S. Cl. ..... 313/553; 313/556; 313/557; 313/481; 313/560; 252/181.1; 252/181.4; 420/400

(58) Field of Search ..... 313/553, 481, 313/561, 562, 560, 556, 491–493; 252/181.1–181.4, 181.6, 181.7; 420/400

(56) References Cited

U.S. PATENT DOCUMENTS

| | | | | |
|---|---|---|---|---|
| 1,963,829 A | | 6/1934 | Cooper | 250/27.5 |
| 2,842,640 A | | 7/1958 | Ragan | |
| 2,907,451 A | | 10/1959 | Della Porta | |
| 3,033,354 A | | 5/1962 | Della Porta | |
| 3,225,911 A | | 12/1965 | Della Porta | |
| 3,381,805 A | | 5/1968 | Della Porta et al. | |
| 3,389,288 A | | 6/1968 | Della Porta et al. | |
| 3,558,962 A | | 1/1971 | Reash | |
| 3,669,567 A | | 6/1972 | Della Porta et al. | |
| 3,719,433 A | | 3/1973 | Rabusin | |
| 3,952,226 A | | 4/1976 | Turnbull | |
| 4,134,041 A | | 1/1979 | Della Porta et al. | |
| 4,342,662 A | | 8/1982 | Kimura et al. | |
| 4,486,686 A | | 12/1984 | Della Porta | |
| 4,504,765 A | | 3/1985 | Della Porta | |
| 4,642,516 A | | 2/1987 | Ward et al. | |
| 4,717,500 A | * | 1/1988 | Fisch et al. | 252/181.4 |
| 4,961,040 A | | 10/1990 | Della Porta et al. | |
| 5,118,988 A | | 6/1992 | Della Porta | |
| 6,104,138 A | * | 8/2000 | Martelli et al. | 313/546 |
| 6,107,737 A | * | 8/2000 | della Porta | 313/491 |
| 6,139,768 A | * | 10/2000 | Urso et al. | 252/181.4 |
| 6,306,314 B1 | * | 10/2001 | Martelli et al. | 252/181.6 |

FOREIGN PATENT DOCUMENTS

| | | | | |
|---|---|---|---|---|
| EP | 0226 244 A1 | | 11/1986 | |
| EP | A-853328 | | 7/1998 | |
| EP | 0859 396 A1 | | 8/1998 | |
| FR | 868 093 A | | 12/1941 | |
| JP | 61118950 A | * | 6/1986 | H01J/29/94 |
| JP | 62073536 | | 4/1987 | |
| JP | Hei-2-6185 | | 2/1990 | |
| JP | 3078928 | | 4/1991 | |

OTHER PUBLICATIONS

"Barium Strontium and Calcium as Getters in Electron Tubes" (J. C. Turnbull, Journal of Vacuum Science and Technology, vol. 14, No. 1, Jan./Feb. 1977, pp. 636–639).

* cited by examiner

*Primary Examiner*—Nimeshkumar D. Patel
*Assistant Examiner*—Sikha Roy
(74) *Attorney, Agent, or Firm*—Perkins Coie LLP

(57) ABSTRACT

A getter comprising a calcium-aluminum compound including about 39% to about 43% calcium by weight produces a calcium vapor when sufficiently heated. The calcium vapor can condense to form a calcium film on an inside surface of a sealed evacuated enclosure such as a CRT to getter reactive species from the enclosed volume. The calcium-aluminum compound, preferably $CaAl_2$ powder, can be mixed with either nickel powder, titanium powder, or both.

28 Claims, 5 Drawing Sheets

GETTER DEVICE EMPLOYING CALCIUM EVAPORATION

CLAIM OF FOREIGN PRIORITY PURSUANT TO 35 U.S.C. §119

This application claims foreign priority under 35 U.S.C. §119 from Italian Patent Application Serial Number M199A 001409 filed Jun. 24, 1999, incorporated herein by reference for all purposes.

BACKGROUND OF THE INVENTION

1. The Field of the Invention

The present invention relates to getter devices that evaporate calcium to form a calcium film within vacuum systems, and particularly in cathode ray tubes (CRTs) and similar devices.

2. Background

Getter devices based on the evaporation of a metal are commonly known as evaporable getter devices. These devices have been in use since the 1950's for maintaining the vacuum inside cathode ray tubes (also commonly referred to as kinescopes) of televisions and, later, within computer monitors. A CRT is evacuated during its manufacture, typically by means of a mechanical pump, and then hermetically sealed. However, the vacuum within the tube tends to decrease quickly, mainly due to the outgassing of components situated within the CRT. Therefore, getter materials capable of sorbing gas molecules have been used to preserve the required vacuum level necessary for proper CRT operation. Barium has been employed as such a: getter material, as is well known in the art. The high reactivity of barium in air, however, renders it difficult to handle in manufacturing operations, thus barium is frequently used in the form of the air stable compound $BaAl_4$.

The getter material is placed within a CRT before it is sealed, typically by fritting, and then the getter is inductively heated by radiofrequency (RF) radiation from a RF source, such as an inductance coil, located outside of the CRT. The heating from the RF radiation is sufficient to evaporate barium that subsequently condenses as a film on the internal walls of the tube. The film then provides a very high surface area for gettering reactive gas species from the enclosed volume.

The getter material is commonly placed within some type of container prior to being sealed within a CRT both for ease of handling and to improve the evaporation process. The getter material is typically pressed into the container, and hereinafter a compressed getter material formed within a container will be referred to as a powder packet. The container can be as simple as a short cylinder open at one end. Other containers take the form of a metal disk or ring with an annular channel formed into one side for holding the getter material. Various container shapes are described in U.S. Pat. Nos. 2,842,640, 2,907,451, 3,033,354, 3,225,911, 3,381,805, 3,719,433, 4,134,041, 4,504,765, 4,486,686, 4,642,516 and 4,961,040, each incorporated herein by reference. Moreover, in order to impart greater homogeneity to the induction heating of the powder packet, a discontinuous metal element, disposed essentially parallel to the container bottom, can be placed within the packet itself as described in U.S. Pat. No. 3,558,962 and in European patent application EP-A-853328, both incorporated herein by reference.

Barium evaporation requires temperatures of about 1200° C., and thus consumes considerable energy. However, it is well known in the art that when a powder of $BaAl_4$ is mixed with a nickel powder and the mixture is heated to a temperature of about 850° C., the following exothermic reaction takes place:

$$BaAl_4+4Ni \rightarrow Ba+4NiAl$$

The heat generated by this exothermic reaction further raises the temperature of the system to that required for barium evaporation. Consequently, mixtures with powdered nickel require less heating from the outside in order to produce barium vapor.

Barium evaporable getters have been further improved, for example, by the addition of up to 5% by weight of a compound selected from amongst the group consisting of iron nitride, germanium nitride, nitrides of iron-germanium alloys, and mixtures thereof. In these devices nitrogen is released immediately before the calcium begins to evaporate, and the effect of the nitrogen is to create a more diffuse metal film having a more homogeneous thickness. Examples of nitrogenated devices for barium evaporation are given in U.S. Pat. Nos. 3,389,288 and 3,669,567 which are both incorporated herein by reference.

In order to better protect a device against atmospheric gasses, especially during the fritting operation referred to above, the powder, or some portion thereof, can be covered with a protective film. Such films are generally glassy layers comprised of boron oxide as the predominant or sole component. Getter devices completely covered by a thin film of a boron compound possibly containing silicon oxide up to 7% by weight are described in U.S. Pat. No. 4,342,662, incorporated herein by reference. Other getter devices in which at least the particles of nickel are protected by boron oxide are described in Japanese patent Hei-2-6185, incorporated herein by reference.

One problem associated with barium-based getter devices is that particles can be ejected during barium evaporation. U.S. Pat. No. 5,118,988, incorporated herein by reference, describes this problem and provides a solution through the use of radial depressions formed into the free surface of the powder in the container. Between two and eight, and typically four, such radial depressions are used to reduce heat transport in a circumferential direction within the powder to achieve the desired effect.

Other problems associated with the use of barium as a getter material, however, are more intractable. First, like all heavy metals, barium is a toxic element and therefore its use requires particular precautions in all production steps of the compound $BaAl_4$, as well as in the disposal of CRTs to avoid ecological problems.: Further, where barium inside a CRT is hit by the high energy electron beam used to excite phosphors and generate an image, the barium will emit harmful X-rays that can escape from the CRT and pose an additional health hazard.

The article "Barium, Strontium and Calcium as Getters in Electron Tubes" (J. C. Turnbull, Journal of Vacuum Science and Technology, vol. 14, no. 1, January/February 1977, pp. 636–639) considers the possibility of replacing barium: with either strontium or calcium for applications in kinescopes. The strontium and calcium precursor materials used in this study are obtained by melting mixtures containing 40% of Sr and 60% of Al, and 35% of Ca and 65% of Al respectively, where all percentages are by weight. Analyses of the materials thus obtained show that in the first case the resulting material is a mixture of the compound $SrAl_4$ with free Al, and in the second case is a complex mixture of phases, containing the compounds $CaAl_2$, CaAl and CaO without free Al.

The results of the Turnbull study further show that it is possible to obtain a strontium film having gas sorption features comparable with those of barium film, while calcium gives a much poorer result. Particularly, the study shows that given the same weight of metal, a strontium film has a sorption capacity for oxygen that is 75% of that of a barium film, whereas the capacity of a calcium film is only 25% of that of the barium film. Confirming these results is U.S. Pat. No. 3,952,226 issued to Turnbull that describes the use of strontium-based evaporable getters to substitute for barium-based getters, but omits the possibility of employing similar calcium-based devices.

Additionally, it should be noted that world-wide production of CRTs has always been based exclusively on the use of barium as the getter film, and of the compound $BaAl_4$ as the precursor to the film. It is clear, therefore, that despite all of the disadvantages of using barium as a getter material in CRTs, in half of a century no better alternative has yet been devised that is both economical and effective.

It is an object of the present invention, therefore, to provide a getter material that does not include barium yet has comparable sorption characteristics and that can be readily substituted for the barium precursors presently used in existing manufacturing processes for devices maintained under vacuum such as CRTs.

SUMMARY OF THE INVENTION

The present invention provides a getter device for maintaining a vacuum in a sealed enclosure. The device comprises a calcium-aluminum compound including about 39% to about 43% calcium by weight, and is capable of producing a calcium vapor when heated. The calcium vapor can subsequently condense to form a calcium film on an inside surface of the sealed enclosure that can getter reactive gases from inside the sealed enclosure. The calcium-aluminum compound is preferably $CaAl_2$ as this compound is stable in air and therefore easier to store, handle, and use. The $CaAl_2$ is preferably powdered with a particle size less than about 500 $\mu$m and preferably between about 50 $\mu$m and about 250 $\mu$m. Calcium-based getter devices are desirable as an alternative to barium-based evaporable getters and provide a film with a gettering capacity that in some embodiments is superior on a per weight basis to that obtainable by a barium film.

The $CaAl_2$ can also be mixed with a nickel powder, a titanium powder, or both, where the added metal has a particle size less than about 100 $\mu$m and preferably between about 20 $\mu$m and about 70 $\mu$m. $CaAl_2$-nickel mixtures can have a weight ratio of $CaAl_2$ to nickel between about 20:80 and about 45:55 and preferably between about 38:62 and about 42:58. $CaAl_2$-titanium mixtures can have a weight ratio of $CaAl_2$ to titanium between about 40:60 and about 75:25 and preferably between about 45:55 and about 50:50. The $CaAl_2$, either alone or mixed with an added metal, can further include up to about 4% by weight of a compound selected from amongst the group consisting of iron nitride, germanium nitride, nitrides of iron-germanium alloys, and mixtures thereof. Further still, one or more of the powders in the getter device can itself include a boron-based protective film in order to protect the powders against atmospheric gasses. The mixtures of the present invention are advantageous because the added metal reacts exothermically with the $CaAl_2$ and therefore they require less inductive heating to produce a calcium vapor. The mixtures with nickel are further advantageous because there is almost no dependency between the supplied heating power and the amount of calcium vapor produced, and this is true even after the mixture has been exposed to oxidizing gases and high temperatures.

A getter device of the present invention can by used as a free powder or can be placed within an open container for easy of handling and better evaporation performance. When placed in an open container, the powder can either be loose or compacted. Either way, a powder in an open container will have a free surface facing the opening. The free surface of the powder can have at least two and as many as eight radial depressions to reduce the likelihood of particles being ejected during calcium evaporation. The getter device can further include a discontinuous metal element disposed essentially parallel to a bottom of the container in order to impart greater homogeneity to the induction heating of the powder.

These and other aspects and advantages of the present invention will become more apparent when the detailed description below is read in conjunction with the accompanying drawings.

BRIEF DESCRIPTION OF THE DRAWINGS

The present invention will be readily understood by the following detailed description in conjunction with the accompanying drawings, with like reference numerals designating like elements.

DETAILED DESCRIPTION OF THE PREFERRED EMBODIMENTS

Figure 1:
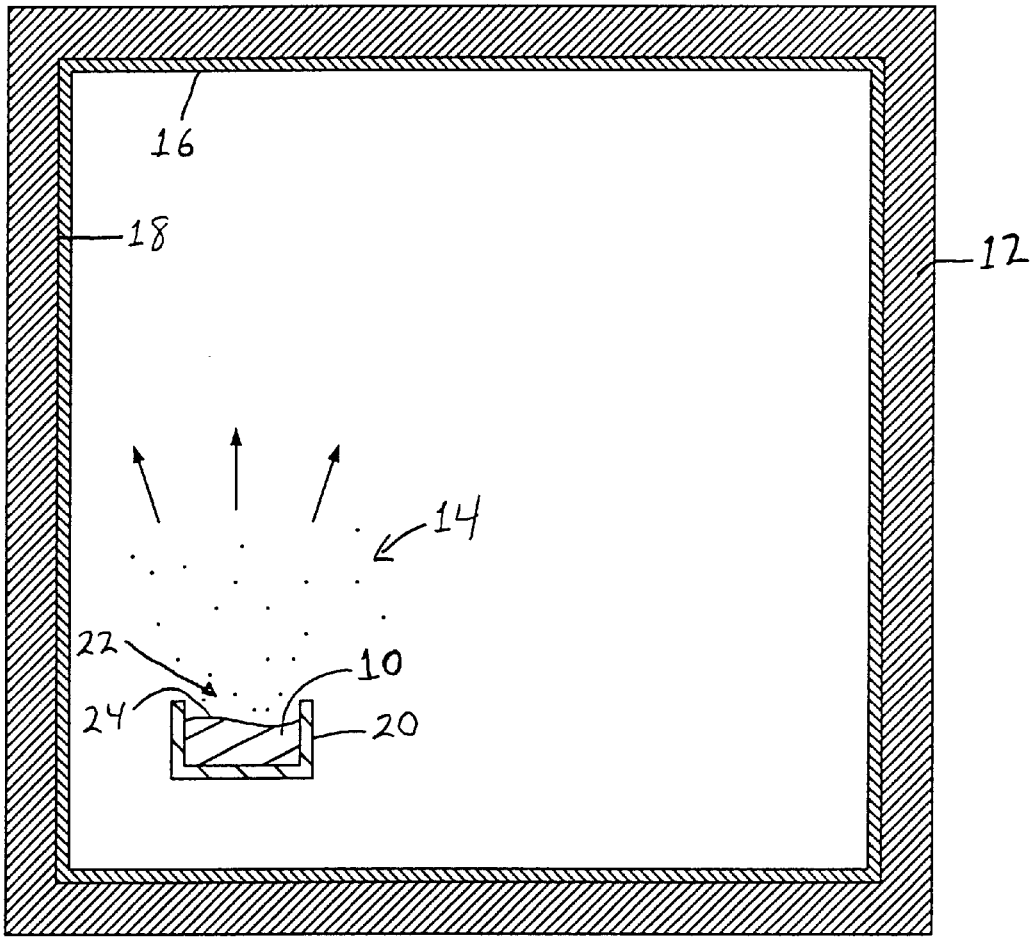
FIG. 1 shows an embodiment of a getter device of the present invention within a sealed enclosure.

FIG. 1 shows a getter device 10 of the present invention disposed within a sealed enclosure 12. The getter device 10 comprises a calcium-aluminum compound including about 39% to about 43% calcium by weight. When heated, the compound produces a calcium vapor 14 that condenses to form a calcium film 16 on an inside surface 18 of the sealed enclosure 12.

Calcium-aluminum compounds containing about 39% to about 43% by weight of calcium are capable of producing calcium films with gas sorption capacities, on a per weight basis, greater than those obtainable by barium films. Compositions containing more than about 43% by weight of calcium, however, contain free calcium and are consequently unstable when exposed to air. Further, the calcium oxide that is formed when these compositions are exposed to air can interfere with the proper functioning of the getter device 10. Because of the free calcium, compositions containing more than about 43% by weight of calcium would also create problems in the production, storage, and shipment of calcium-based getter devices 10. On the other hand, compositions containing less than about 39% calcium when heated yield a decreasing amount of calcium vapor 14 without offering compensating advantages. Among the calcium-aluminum compounds provided by the present invention, the compound $CaAl_2$ is preferred. The compound $CaAl_2$ maximizes the calcium vapor 14 yield and is stable in air.

A getter device 10 containing only the compound $CaAl_2$ is defined as being of the "endothermal" type. These devices are so defined because all of the heat required for calcium evaporation must be supplied from the outside, normally through induction heating. Alternatively, an "exothermal" type getter device 10 derives part of the heat for calcium evaporation from an exothermic reaction between $CaAl_2$ and another metallic component. The component can be nickel, as in the barium-based getter devices previously described. Alternatively, titanium may also be used. It has been found that a getter device 10 including titanium will have different properties than one including nickel, as described below.

Mixtures of $CaAl_2$—Ni display almost no dependence between the RF power supplied to heat the getter device 10 and the amount of calcium vapor 14 produced. This has been found to be true even after getter device 10 has been exposed to oxidizing gases and high temperatures during the production of a CRT. This behavior appears to be linked to the high reactivity of these mixtures, in that they release almost all of their calcium as soon as a threshold temperature for the exothermic reaction is reached. This feature can greatly simplify the CRT production process by allowing a lesser degree of control of the induction heating parameters used to evaporate the getter material, such as the power supplied to the induction coil or the total heating time. It should be noted, however, that calcium evaporation by the reaction of $CaAl_2$ with Ni may be rather violent, so it is preferred to use this mixture only in a getter device 10 that will require a small quantity of the mixture.

$CaAl_2$—Ti mixtures behave similarly to the barium-based ones, with the calcium vapor 14 yield depending on the induction heating power (that influences the starting time for the evaporation) and the total induction heating time. Getter devices 10 can be prepared such that $CaAl_2$ is mixed with both nickel and titanium, leading to an intermediate behavior between the two described above.

The compound $CaAl_2$ can be prepared simply by melting calcium and aluminum metals together in the stoichiometric ratio. The melting can be performed in an oven of any kind, for instance an induction one, but is preferably made under an inert atmosphere such as nitrogen. Once produced, the $CaAl_2$ may be powdered, which is the preferred form for a getter device 10. Generally, a particle size smaller than about 500 $\mu$m is desirable and a particle size between about 50 $\mu$m and about 250 $\mu$m is preferable.

For exothermal devices, where the added metal is nickel, titanium, or a mixture of the two, the added metal is preferably also in the form of a powder having a particle size less than about 100 $\mu$m and more preferably between about 20 $\mu$m and about 70 $\mu$m. For particle sizes greater than about 100 $\mu$m, the contact area with the particles of $CaAl_2$ is reduced, reducing the exothermic effect of the mixture upon heating. At the other extreme, for particle sizes lower than about 20 $\mu$m, the powders become more difficult to transport and, in the case of titanium, possibly pyrophoric.

The weight ratio between $CaAl_2$ and the added metal can vary within broad limits. Particularly, when nickel is used, the weight ratio $CaAl_2$:Ni can vary between about 20:80 and about 45:55, and preferably between about 38:62 and about 42:58. For mixtures with titanium, the ratio $CaAl_2$:Ti can vary between about 40:60 and about 75:25, and preferably between about 45:55 and about 50:50. The use of higher amounts of $CaAl_2$ than those indicated necessarily leads to too little added metal, and thus very little heat is generated by the exothermic reaction. On the other hand, use of nickel or titanium in amounts greater than those indicated creates a getter device 10 that produces insufficient calcium vapor 14. Additionally, a getter device 10 of the present invention can include up to about 5% by weight of a compound selected from amongst the group consisting of iron nitride, germanium nitride, nitrides of iron-germanium alloys, and mixtures thereof. Additions of these nitrides provides the same general benefits described with respect to barium-based getters.

Both endothermal and exothermal devices can be formed as a powder packet disposed within a metal container 20, preferably made of steel. The container 20 has an opening 22 and in the case of the smaller devices 10 has generally the shape of a short cylinder. For larger devices 10, a container 20 consisting of a metal body having an annular channel formed therein is preferred. The getter device 10 is disposed within the annular channel. The channel can have a substantially rectangular cross-section and include the opening 22. Thus, it will be appreciated that the container 20 may have essentially the same shape as any container known in the barium-based evaporable getter art, as previously described.

Similarly, both exothermal and endothermal devices 10 can have a number of radial depressions formed into a free surface 24 of the powder packet to reduce a problem of solid particles being ejected during calcium evaporation. Moreover, in order to impart greater homogeneity to the induction heating of the powder, a discontinuous metal element, disposed essentially parallel to the container bottom, can be placed within the device 10. Finally, in order to enhance protection of a device 10 against atmospheric gasses, a protective film comprising a boron compound can be used. Each of these techniques have been described above with reference to barium-based evaporable getters and are similarly employed with the calcium-based devices of the present invention.

The invention will be further illustrated in the following examples. These non limiting examples illustrate various embodiments to better teach those skilled in the art how to put the invention into practice.

EXAMPLE 1

100 g of $CaAl_2$ are prepared by melting 42.6 g of calcium shavings and 57.4 g of aluminum drops in a refractory crucible made of mixed aluminum and magnesium oxides. The melting is performed under nitrogen in an induction oven. After the melt has solidified, the ingot is ground and the powders sieved to recover a fraction having a particle size less than about 210 $\mu$m. X-ray diffractometry of the resultant powder confirms that the material is $CaAl_2$.

EXAMPLE 2

20 g of $CaAl_2$ powder prepared as described in Example 1 is mixed with 80 g of nickel powder having an average particle size of 40 $\mu$m. A set of devices 10 for calcium evaporation are prepared from this mixture, each formed within a steel container 20 having an external diameter of 20 mm and including an annular channel having a channel width of 6 mm. Each container 20 is loaded with 1 g of the mixture by compressing the powder with a shaped punch to which a pressure of about 6,500 kg/cm$^2$ is applied. The nominal calcium quantity in each device is 85 mg.

EXAMPLE 3

Five devices 10 produced as described in Example 2 are subjected to a calcium evaporation test. Each device 10 is weighed and introduced into a glass flask that is then evacuated. The device 10 is inductively heated from outside by a coil positioned near the device 10. The total time (TT) for heating, being the time during which power is applied through the coil, is 30 seconds in all tests. Although the heating time is held constant in each test, the power is varied so as to vary the triggering moment of the evaporation, defined as "Start Time" (ST). The higher the power, the faster the heating of the device 10 and the sooner calcium evaporation begins. At the end of the evaporation test each device 10 is removed from the flask and re-weighed. From the weight difference between the two weighings the quantity of evaporated calcium is determined. The results of the five tests, showing calcium yield (total evaporated calcium) as a function of the ST, are given in Table 1 and graphically in FIG. 2. Calcium yield is given as the percentage of the total calcium contained in the initial device 10. Values obtained in the five tests are indicated by circles, while Line 1 shows the interpolation of these values by the least squares method.

TABLE 1

| Start Time (seconds) | Evaporated Ca (milligrams) |
|---|---|
| 12.1 | 48 |
| 14.4 | 51 |
| 15.2 | 50 |
| 16.5 | 55 |
| 16.6 | 52 |

EXAMPLE 4

Figure 2:
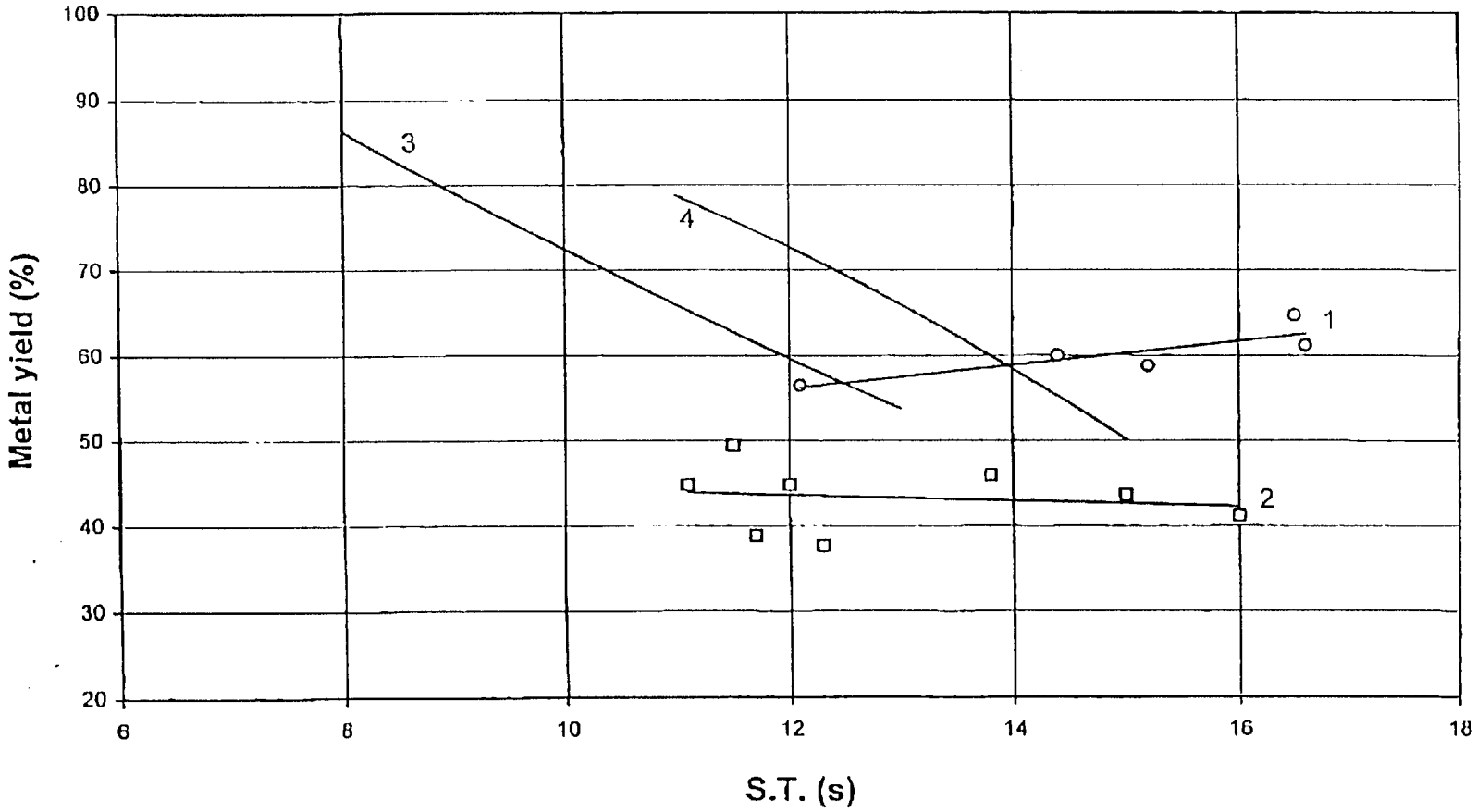
FIG. 2 shows metal yields as a function of start time for metal evaporation by getter devices of the present invention and of the prior art.

Nine devices 10 produced as described in Example 2 are subjected to a calcium evaporation test after having been heated in air for one hour at a temperature of 450° C. This treatment simulates the conditions to which a device 10 would be subjected to during the fritting operation used to seal a CRT. In this operation the front and back glass portions of a CRT are sealed with a low melting point glass paste. During this treatment the getter device 10 is partially oxidized which can create a problem of excessive exothermicity during the evaporation test. After the oxidation treatment at 450° C., the device 10 is subjected to the evaporation test according to the method described for Example 3. The test results are given in Table 2 and graphically in FIG. 2. In FIG. 2 the values obtained in these tests are indicated with squares, while Line 2 shows the interpolation of these values by the least squares method.

TABLE 2

| Start Time (seconds) | Evaporated Ca (milligrams) |
|---|---|
| 11.1 | 38 |
| 11.5 | 42 |
| 11.7 | 33 |
| 12.0 | 38 |
| 12.0 | 38 |
| 12.3 | 32 |
| 13.8 | 39 |
| 15.0 | 37 |
| 16.0 | 35 |

For comparison, FIG. 2 also shows two curves that represent barium evaporation devices according to the prior art. Curve 3 shows the results obtained with a barium getter device tested according to the procedure described in Example 3, and Curve 4 shows the results obtained with a barium getter device tested according to the procedure described in Example 4.

FIG. 2 shows the metal yield of an exothermal $CaAl_2$—Ni getter device 10 and of a prior art barium-based getter as a function of ST with TT held equal, both for devices subjected to a fritting treatment and for devices not subjected to said treatment. From the comparison of the metal yield curves in FIG. 2 it may be deduced that:

unlike the barium devices of the prior art, embodiments of the present invention that use nickel as an added metal have a calcium yield that is essentially independent from the evaporation Start Time, and therefore from the applied power, allowing for the use of lower power levels; and the calcium yield of devices 10 of the present invention is essentially independent from the S.T. even after fritting.

By virtue of these two features, the power supplied through the coil can be reduced with $CaAl_2$—Ni devices 10, and also a lesser degree of control of the evaporation parameters is required. Moreover, for barium devices of the prior art, variations of ST or TT (for example through an error in the control of these parameters in a CTR manufacturing process) can create considerable differences in the quantity of evaporated barium and therefore the suitability of the deposited film. With the devices 10 of the present invention similar variations of ST or TT have practically no influence on the metal yield.

EXAMPLE 5

In this example the gas sorption performance of a calcium film 16 produced by a getter device 10 of the present invention is evaluated.

A device 10 produced as described in Example 2 is introduced into a measuring chamber 12 having an internal volume of 8.35 liters. The chamber 12 is evacuated with a turbomolecular pump and subjected to a degassing treatment of the walls at 150° C. for 16 hours while the vacuum is maintained. At the end of the degassing treatment the pumping is stopped and calcium is evaporated with a TT of 30 seconds.

The gas sorption test is then started, using carbon monoxide CO as the test gas. For each test CO is introduced into the chamber 12 such that the pressure in the chamber 12 is brought to a value of $8.8\times10^{-3}$ mbar. A capacitive manometer is used to measure the pressure decrease in the measuring chamber 12 due to sorption of CO by the calcium film 16. When the pressure in the chamber 12 has been reduced to about $1.33\times10^{-4}$ mbar, CO is again introduced to bring the pressure back to $8.8\times10^{-3}$ mbar. The results of this sorption test are graphically given in FIG. 3 as Curve 5, which shows S, the sorption rate per gram of calcium film 16, as a function of Q, the CO quantity sorbed per gram of film 16.

Figure 3:
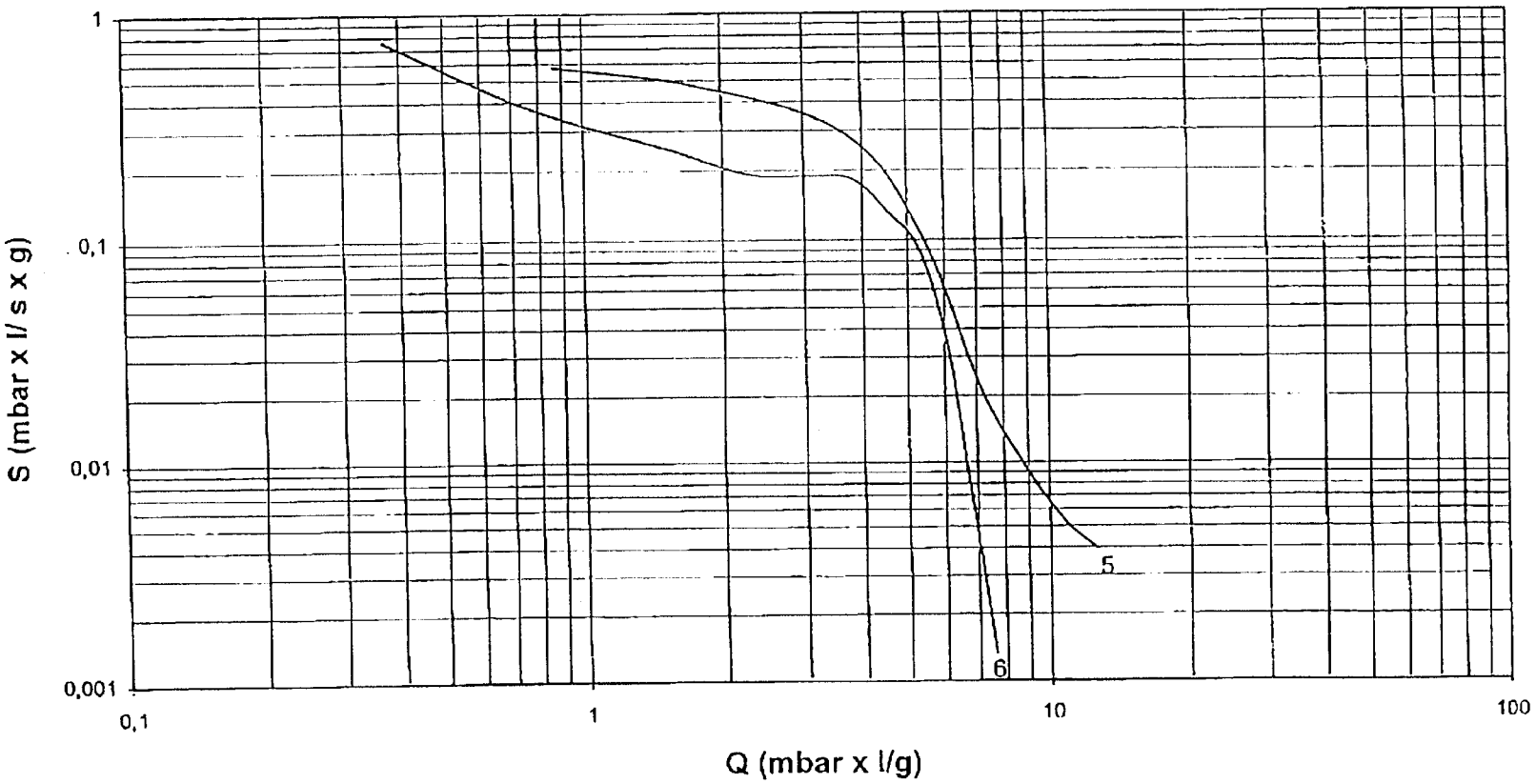
FIG. 3 shows a graphical comparison of the gas sorption rate as a function of the gas quantity sorbed by both a calcium film and a barium film for equal weights of the two metals.

The graph in FIG. 3 is generated by measuring the average CO sorption rate during the first 4 seconds after each new gas addition. This value is reported as a fraction of the total CO quantity supplied to the sample during the various dosages. The parameter S is determined by measuring a quantity of CO gas in millibars per liter (mbar×1) divided by the test time in seconds (s) and by the weight of the calcium film 16 in grams (g). The parameter Q is determined as the quantity of gas in millibars per liter divided by the weight of the calcium film 16 in grams. The sorption capacity of the film 16 is considered to be exhausted when the pumping rate is reduced to 1% of the initial value. At the end of the test the total sorption capacity of the calcium film is calculated.

This test is repeated to show the reproducibility of the obtained data. The results of the two tests are summarized in Table 3.

EXAMPLE 6 (COMPARATIVE)

The test of Example 5 is repeated on a production barium getter device, comprising 570 mg of a mixture consisting of 47% $BaAl_4$ and 53% Ni, for a nominal Ba content of 150 mg. The test results are given in FIG. 3 as Curve 6. The test is repeated to show the reproducibility thereof, and the results of the two tests are also summarized in Table 3. Table 3 shows for each test the compound used for evaporation of the alkaline-earth metal, the evaporated metal yield, the total quantity of sorbed CO, and the film rapacity (capacity per unit weight of film).

TABLE 3

| Compound | Metal yield (g) | Total sorbed CO (mbar × l) | Total capacity (mbar × l/g) |
|---|---|---|---|
| $CaAl_2$ | 0.040 | 0.31 | 7.7 |
| $CaAl_2$ | 0.042 | 0.30 | 7.1 |
| $BaAl_4$ | 0.093 | 0.55 | 5.9 |
| $BaAl_4$ | 0.123 | 0.63 | 5.1 |

The results given in FIG. 3 and Table 3 demonstrate that a device 10 of the present invention can be used to obtain a calcium film 16 having a gas sorption capacity per unit of metal weight that is comparable to, and even slightly higher than, that of a barium film obtained according to the prior art.

EXAMPLE 7

45 g of $CaAl_2$ powder prepared as described in Example 1 is mixed with 55 g of titanium powder having an average particle size of 30 $\mu$m. A set of devices 10 for calcium evaporation are prepared with this mixture, each formed of 500 mg of the mixture disposed within a steel container 20 with an annular channel, where each container 20 has an external diameter of 20 mm and channel width of 6 mm. The mixture in each device 10 is pressed into the channel with a punch by applying a pressure of about 18,000 kg/cm$^2$. The nominal loading of calcium in each device is 96 mg.

EXAMPLE 8

The test of Example 3 is repeated on a series of samples prepared as described in Example 7. The TT value is 30 seconds in each test. The results of these tests are given in the graph in FIG. 4.

EXAMPLE 9

The test of Example 8 is repeated on a series of devices 10 that, after preparation, are subjected to a heat treatment in air at 450° C. for 1 hour. This treatment simulates the conditions to which a device 10 would be subjected to during the fritting operation used to seal a CRT. The results of these tests are given in the graph in FIG. 5.

Figure 4:
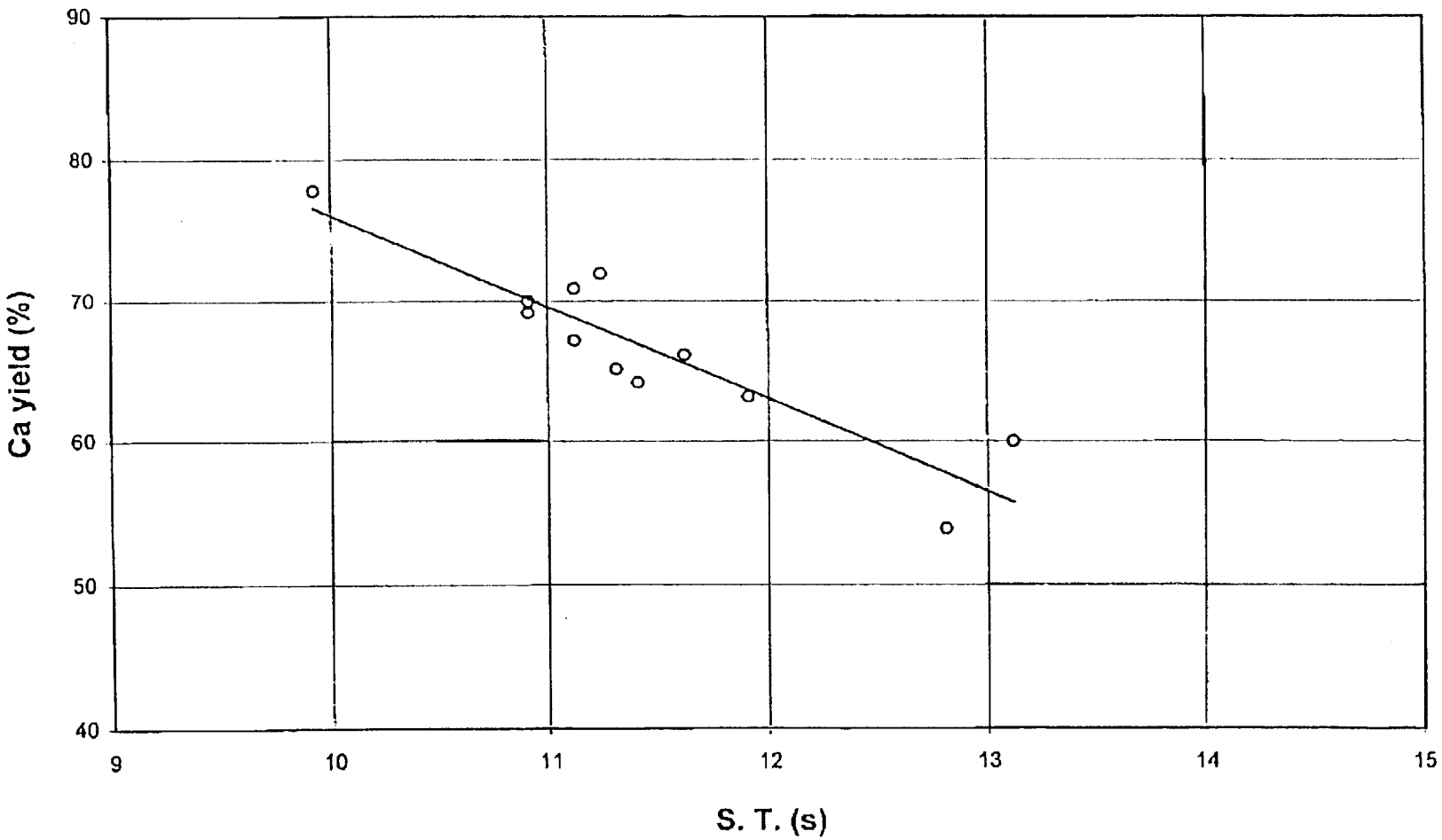
FIG. 4 shows calcium yield as a function of start time for calcium evaporation by getter devices according to another embodiment of the present invention.
Figure 5:
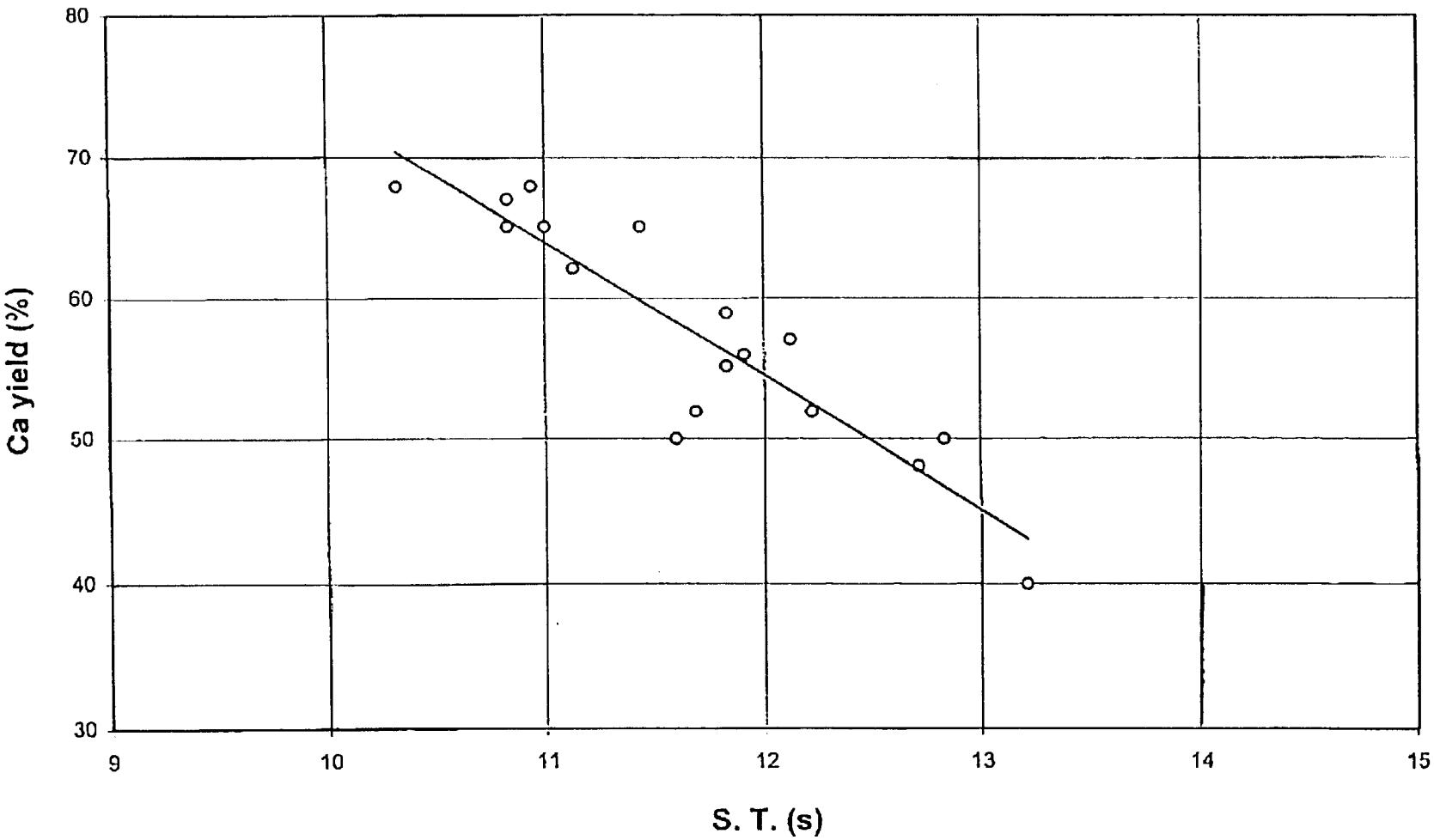
FIG. 5 shows calcium yield as a function of start time for calcium evaporation by getter devices according to another embodiment of the present invention after a fritting simulation test.

FIGS. 4 and 5 show that $CaAl_2$—Ti mixtures also have good calcium-releasing properties, with a yield that is over 80% of the nominal calcium content (96 mg) at high applied powers (lower ST values) when used in non-fritted devices, and over 75% when used in fritted devices.

What is claimed is:

1. A getter device for maintaining a vacuum in a sealed enclosure comprising a calcium-aluminum compound including 39% to 43% calcium by weight, said compound being capable of producing a calcium vapor when heated, whereby said calcium vapor can condense to form a calcium film on an inside surface of said sealed enclosure.

2. The getter device according to claim 1 wherein said calcium-aluminum compound is $CaAl_2$.

3. The getter device according to claim 1 wherein said calcium-aluminum compound is disposed within a metal container.

4. The getter device according to claim 3 wherein said container has the shape of a short cylinder with an opening.

5. The getter device according to claim 3 wherein said container is a metal body including an annular channel formed therein, said annular channel having a substantially rectangular cross-section.

6. The getter device according to claim 3, wherein said calcium-aluminum compound is powdered.

7. The getter device according to claim 6, wherein said powdered calcium-aluminum compound has a particle size less than about 500 $\mu$m.

8. The getter device according to claim 7, wherein said particle size is between about 50 $\mu$m and about 250 $\mu$m.

9. The getter device according to claim 6 further including nickel, wherein said calcium-aluminum compound is mixed with said nickel to form a mixture thereof.

10. The getter device according to claim 9, wherein said nickel is powdered and said mixture is in a form of a powder packet.

11. The getter device according to claim 10, wherein said nickel has a particle size less than about 100 $\mu$m.

12. The getter device according to claim 11, wherein said nickel particle size is between about 20 $\mu$m and about 70 $\mu$m.

13. The getter device according to claim 9, wherein a weight ratio of said calcium-aluminum compound to said nickel is between about 20:80 and about 45:55.

14. The getter device according to claim 13, wherein said weight ratio is between about 38:62 and about 42:58.

15. The getter device according to claim 9, further comprising up to about 4% by weight of a compound selected from amongst the group consisting of iron nitride, germanium nitride, nitrides of iron-germanium alloys, and mixtures thereof.

16. The getter device according to claim 10, wherein a free surface of said powder packet has at least two and as many as eight radial depressions.

17. The getter device according to claim 10, wherein said powder packet further includes a discontinuous metal element, said metal element disposed essentially parallel to a bottom of said container.

18. The getter device according to claim 10, wherein at least one of said powders further includes a boron-based protecting film.

19. The getter device according to claim 6 further including titanium, wherein said calcium-aluminum compound is mixed with said titanium to form a mixture thereof.

20. The getter device according to claim 19, wherein said titanium is powdered and said mixture is in a form of a powder packet.

21. The getter device according to claim 20, wherein said titanium has a particle size less than about 100 $\mu$m.

22. The getter device according to claim 21, wherein said titanium particle size is between about 20 $\mu$m and about 70 $\mu$m.

23. The getter device according to claim 19, wherein a weight ratio of said calcium-aluminum compound to said titanium is between about 40:60 and about 75:25.

24. The getter device according to claim 23, wherein said weight ratio is between about 45:55 and about 50:50.

25. The getter device according to claim 19, further comprising up to about 4% by weight of a compound selected from amongst the group consisting of iron nitride, germanium nitride, nitrides of iron-germanium alloys, and mixtures thereof.

26. The getter device according to claim 20, wherein a free surface of said powder packet has at least two and as many as eight radial depressions.

27. The getter device according to claim 20, wherein said powder packet further includes a discontinuous metal element, said metal element disposed essentially parallel to a bottom of said container.

28. The getter device according to claim 20, wherein at least one of said powders further includes a boron-based protecting film.

* * * * *